United States Patent [19]

Edwards

[11] Patent Number: 5,052,137

[45] Date of Patent: Oct. 1, 1991

[54] MOUNTING FOR PANELS FOR SIGNBOARDS

[76] Inventor: Lindell N. Edwards, 4367 Chateau De Ville Dr., St. Louis, Mo. 63129

[21] Appl. No.: 476,151

[22] Filed: Feb. 7, 1990

[51] Int. Cl.[5] ..... G09F 7/00

[52] U.S. Cl. ..... 40/611; 40/618

[58] Field of Search ..... 248/448, 449, 451, 452, 248/453, 460; 40/606, 607, 611, 618, 601, 620; 211/94.5

[56] References Cited

U.S. PATENT DOCUMENTS

| | | | |
|---|---|---|---|
| 3,231,230 | 1/1966 | Mueller | 248/449 |
| 3,289,340 | 12/1966 | Edwards . | |
| 3,696,541 | 10/1972 | Pittman | 40/620 |
| 3,720,012 | 3/1973 | Loper | 40/618 |
| 3,722,120 | 3/1973 | Finkel | 40/618 |
| 3,793,757 | 2/1974 | Jaquillard | 40/620 |
| 3,828,937 | 8/1974 | Nash | 248/200.1 |
| 3,878,633 | 4/1975 | McWilliams | 40/618 |
| 4,132,020 | 1/1979 | Nidelkoff | 40/606 |
| 4,265,041 | 5/1981 | Edwards | 40/620 |
| 4,357,773 | 11/1982 | Dennis | 40/607 |
| 4,672,757 | 6/1987 | Field | 40/618 |

FOREIGN PATENT DOCUMENTS

| | | | |
|---|---|---|---|
| 20773 | of 1914 | United Kingdom | 40/618 |

*Primary Examiner*—Ramon O. Ramirez
*Assistant Examiner*—Robert A. Olson
*Attorney, Agent, or Firm*—Polster, Polster and Lucchesi

[57] ABSTRACT

A mounting for a generally vertical signboard includes clips which coact with the signboard to removably secure at least two sizes of indicia to the signboard. The signboard includes ribs which coact with both the indicia and the clips, allowing the indicia to be mounted to the signboard in two modes. The signboard is held vertical by supports. Brackets interact with the supports to enable the positioning of the signboard between a floor and a ceiling. The supports rotate and slide relative to the floor brackets so that the signboard may be tilted from the vertical to facilitate changing of the message displayed on the signboard.

24 Claims, 4 Drawing Sheets

EVERY
PANEL
SELLS
10
25
38
26
42
56
58
44
54
50
48
40
60
3
2
14
12
16
18

12
16
20
24
36
18
42
40
28
32
22
38
26
14
10
54
56

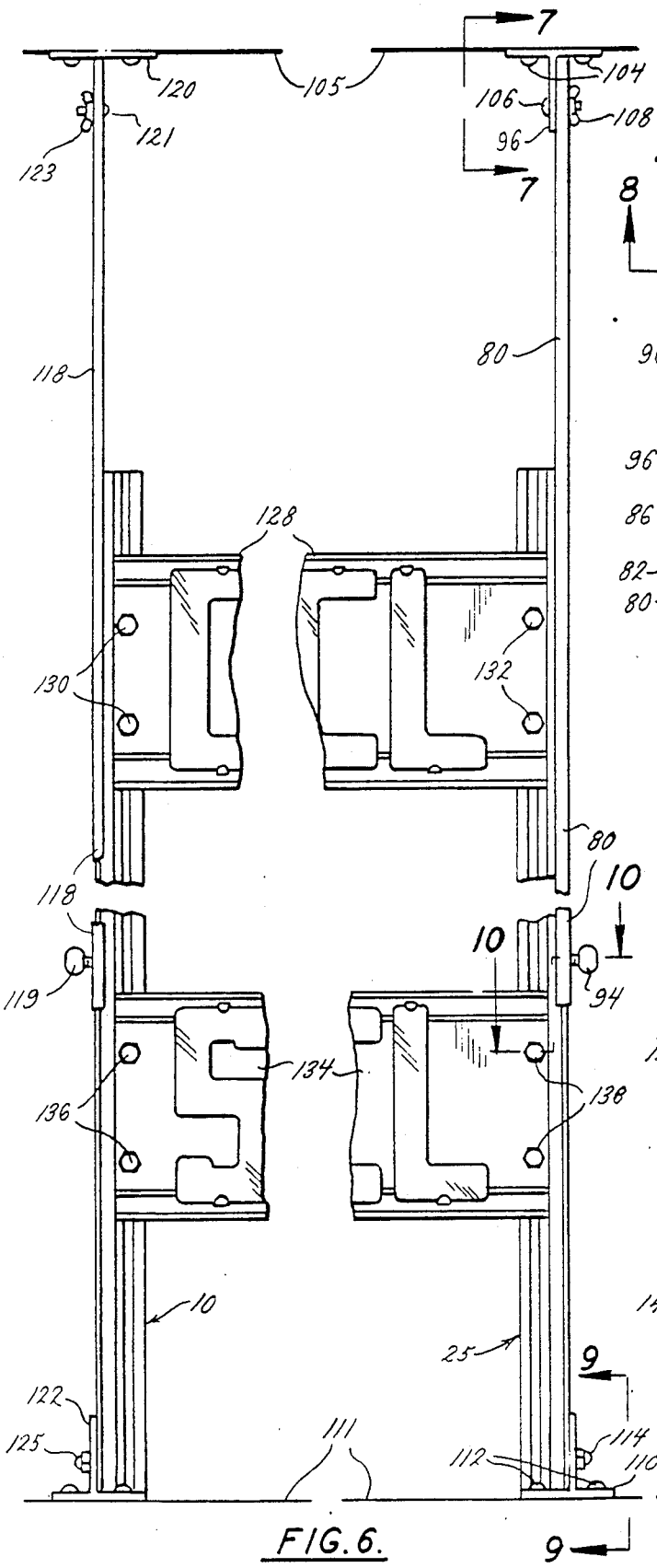
FIG. 6.
FIG. 7.
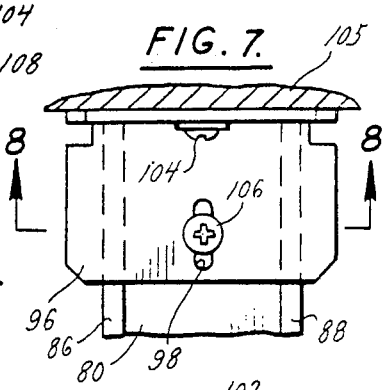
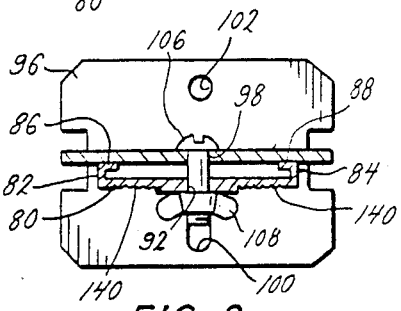
FIG. 8.
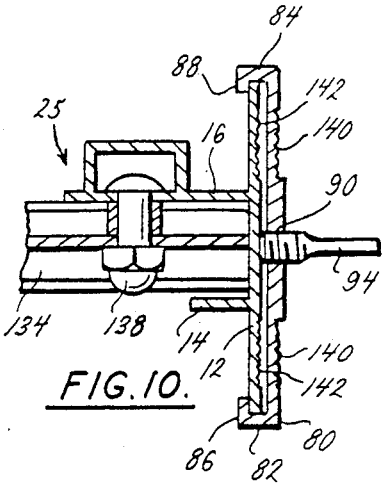
FIG. 10.
FIG. 9.
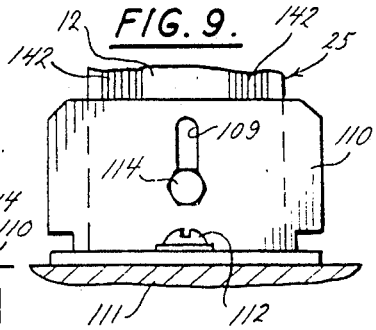

MOUNTING FOR PANELS FOR SIGNBOARDS

SUMMARY OF THE INVENTION

This invention relates to improvements in supports for generally-vertical signboards. More particularly, this invention relates to signboard supports which have axially-slidable extensions that are releasably securable to ceilings of different heights to hold the signboard generally vertical. Those extensions can be freed from a ceiling, and then slid axially toward the lower ends of the supports, to enable the signboard to be rotated downwardly toward the floor to enable the indicia on the signboard to be changed. It is, therefore, an object of the present invention to provide supports, for a signboard, which can be secured to a ceiling to hold that signboard generally vertical and which can be freed from that ceiling to permit that signboard to be rotated downwardly toward the floor to enable the indicia on that signboard to be changed.

This invention relates to improvements in mountings for panels for signboards. More particularly, this invention relates to a mounting for the panels for signboards which can obviate the need of drilling holes in the supports for those panels. As a result, that mounting simplifies and expedites the assembly of signboards. It is, therefore, an object of the present invention to provide a mounting for panels for signboards which can obviate the need of drilling holes in the supports for those panels.

The mounting for panels for signboards, provided by the present invention, facilitates quick and precise positioning of those panels at different positions relative to the signboards. Specifically, by merely loosening and subsequently tightening nuts, it is possible to shift a panel for a signboard to various desired positions relative to that signboard. That shifting can be done very quickly; and it is not limited by the locations of, or by the distances between, drilled holes in the supports for that signboard. It is, therefore, an object of the present invention to provide a mounting for panels for signboards which facilitates quick and precise positioning of those panels at different positions relative to the signboards.

The panels provided by the present invention have tops and bottoms which project forwardly beyond the rest of those panels. Those tops and bottoms coact with flanges on the supports for the signboard to provide a shadow-box effect. The indicia for the signboard are mounted on, but are disposed far enough forwardly of, the panels of the signboard to provide fully exposed indicia which are backed up by a shadow-box effect. It is, therefore, an object of the present invention to provide signboard panels with tops and bottoms that project forwardly beyond the rest of those panels and that coact with flanges on the supports for the signboard to provide a shadow-box effect behind indicia which are supported by those panels.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWINGS

In the drawings.

FIG. 6 is a broken front elevational view, on a smaller scale, of part of a second embodiment of signboard in which the principles and teachings of the present invention are incorporated;

FIG. 7 is a sectional view, on a larger scale, which is taken along a plane indicated by the line 7—7 in FIG. 6;

FIG. 8 is a sectional view, on the scale of FIG. 7, which is taken along a plane indicated by the line 8—8 in FIG. 7;

FIG. 9 is a sectional view, on the scale of FIG. 7, which is taken along a plane indicated by the line 9—9 in FIG. 6; and FIG. 10 is a sectional view, on the scale of FIG. 7, which is taken along a broken plane indicated by the broken line 10—10 in FIG. 6.

DESCRIPTION OF PREFERRED EMBODIMENTS

Figure 1:
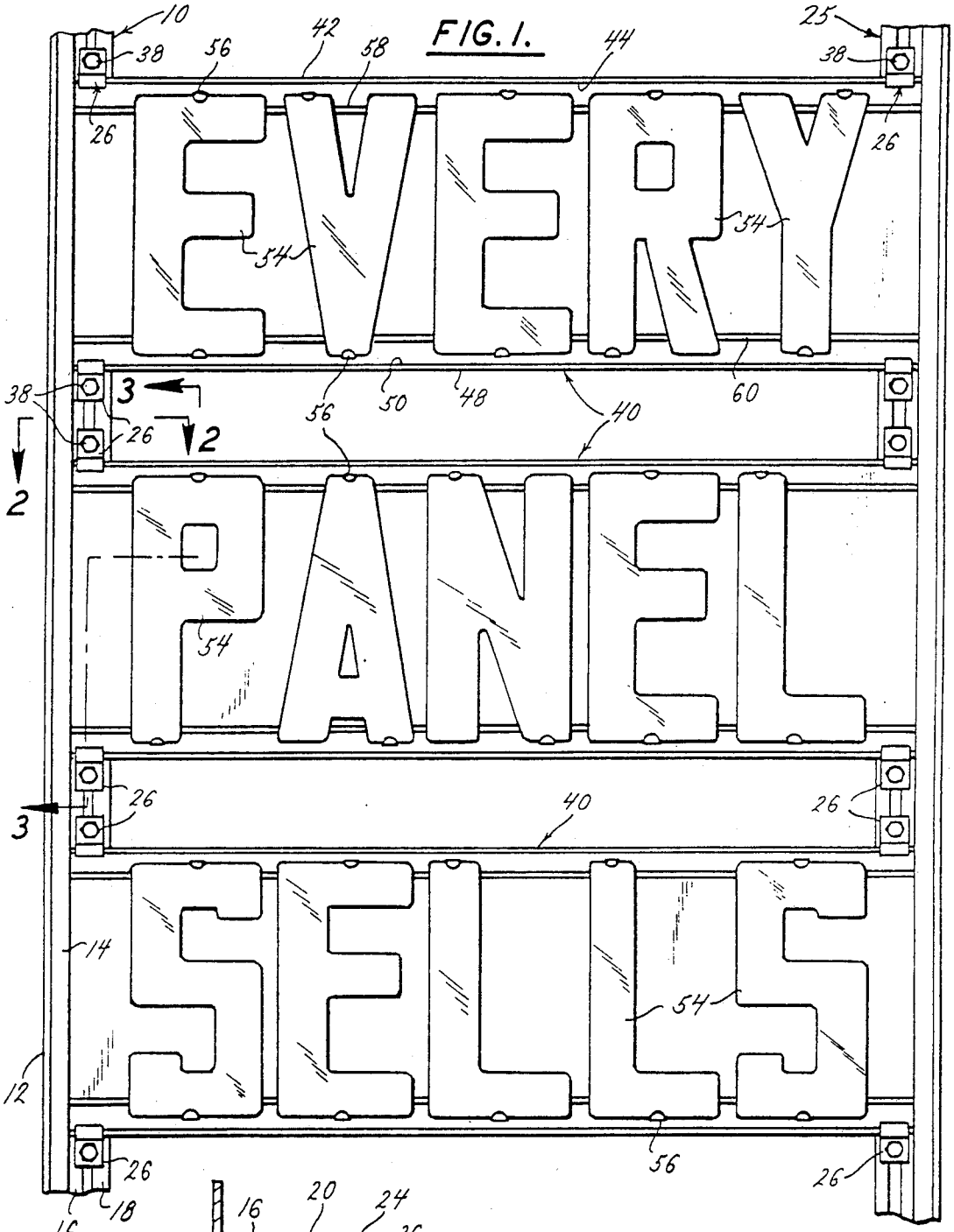
FIG. 1 is a front elevational view of part of one embodiment of signboard in which the principles and teachings of the present invention are incorporated.

Referring to the drawings, the numeral 10 generally denotes a vertical support for the left-hand side of a signboard in which the principles and teaching of the present invention are incorporated. A further vertical support 25, which is a mirror image of the support 10, is provided for the right-hand side of that signboard. A channel, not shown, adjacent the upper ends of the supports 10 and 25, and a further channel, not shown, adjacent the lower ends of those supports coact with those supports to form a sturdy and rugged frame for that signboard.

Figure 2:
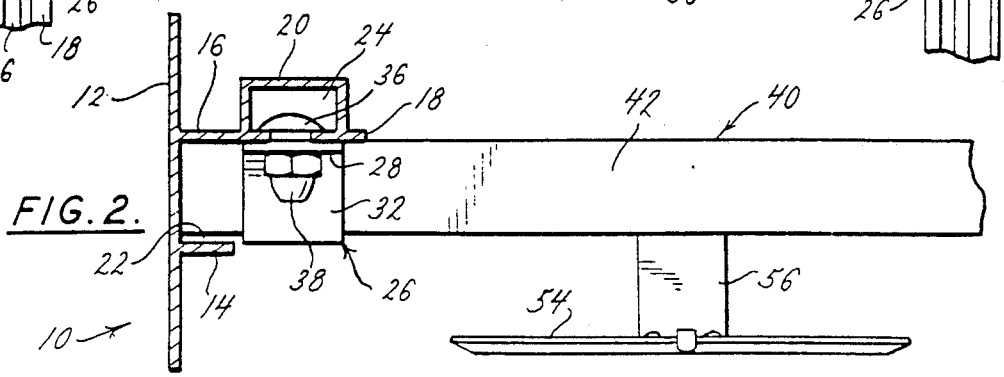
FIG. 2 is a sectional view, on a larger scale, which is taken along a plane indicated by the line 2—2 in FIG. 1.
Figure 3:
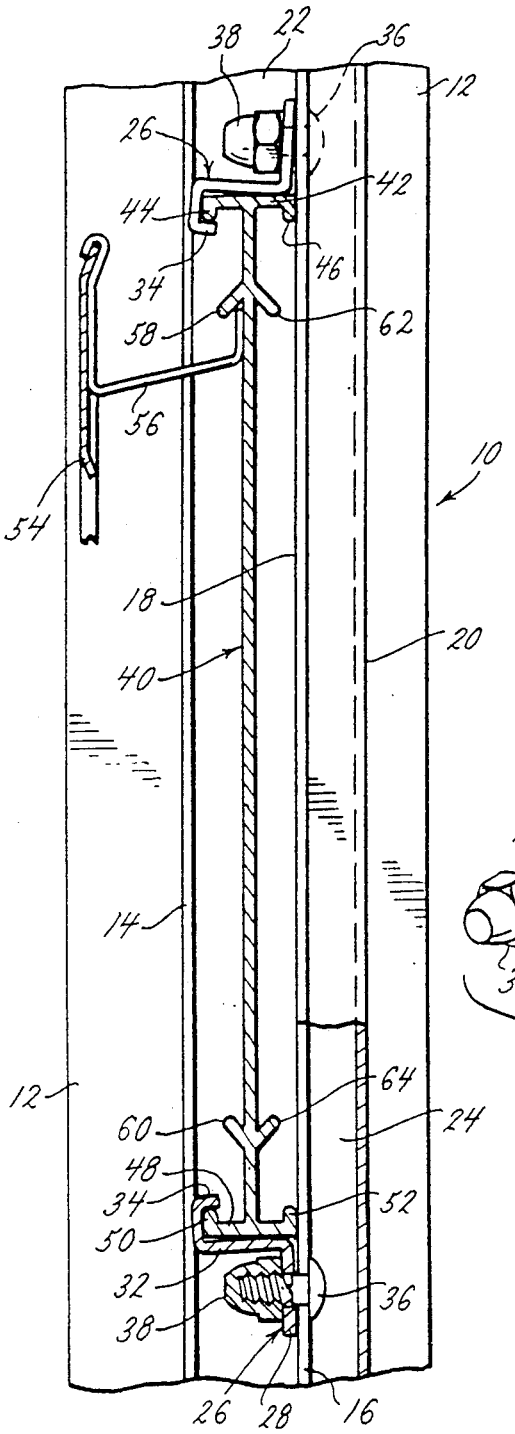
FIG. 3 is a sectional view, on the scale of FIG. 2, which is taken along a broken plane indicated by the broken line 3—3 in FIG. 1.
Figure 4:
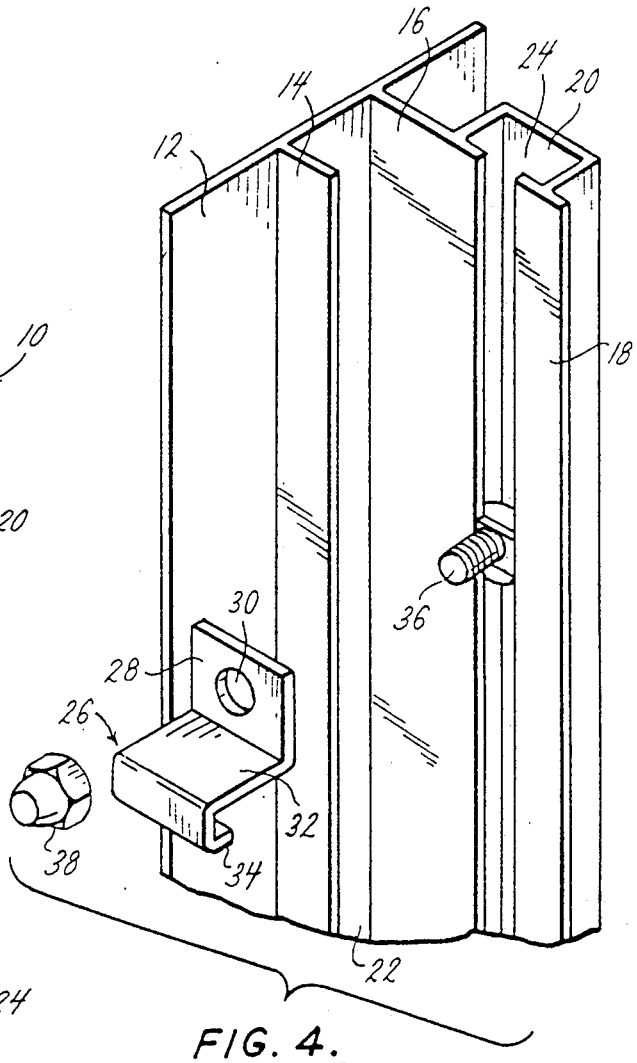
FIG. 4 is a perspective view, on the scale of FIG. 2, of part of one of the vertical supports of the signboard of FIG. 1.

As emphasized particularly by FIGS. 2-4, the support 10 has a side wall 12, a flange 14 which projects at right angles from that side wall, and a deeper flange 16 which also projects from that side wall, and which is parallel to the flange 14. The right-hand portion of the flange 16 defines an elongated surface which has an edge that is parallel to the side wall 12. The numeral 18 denotes a further elongated surface which is coplanar with the flange 16, but which has its inner edge spaced outwardly from the edge of the elongated surface defined by the right-hand portion of flange 16. A channel-like connecting section 20, holds the elongated surface 18 precisely fixed relative to the flange 16. The numeral 22 denotes an elongated recess which is defined by the side wall 12 and flanges 14 and 16. The numeral 24 denotes an elongated recess which is defined by the elongated surface 18, the channel-like connecting section 20 and the elongated surface defined by the right-hand portion of flange 16. As shown particularly by FIGS. 2 and 4, the elongated recesses 22 and 24 are displaced from each other by ninety degrees. The support 25 has a side wall 12, flanges 14 and 16, an elongated surface defined by the outer portion of the flange 16, a further elongated surface 18, a channel-like connecting section 20, and elongated recesses 22 and 24 which are mirror images of their counterparts on the support 10. The flanges 14 and 16 of the support 10 confront, and are coplanar with, the flanges 14 and 16 of the support 25.

The numeral 26 generally denotes an L-shaped clip which is part of the mounting means of FIGS. 1–4. That clip has a vertically-directed planar section 28 with an opening 30 therein; and that clip also has a horizontally-directed planar section 32 with a downwardly and inwardly-bent lip 34. The opening 30 in the planar section 28 of the clip 26 accommodates the shank of a bolt 36 which has a polygonal shoulder immediately adjacent the head thereof. That polygonal shoulder is dimensioned to fit between the confronting edges of the elongated surface 18 and of the elongated surface defined by the right-hand portion of flange 16; and that polygonal shoulder will be held against rotation by those edges. A cap nut 38 can be threaded onto the outer end of the bolt 36.

The numeral 40 generally denotes one of the panels which is provided by the present invention. That panel has a top 42 which projects forwardly and rearwardly of the web of that channel as shown particularly by FIG. 3. An elongated lip 44 depends downwardly from the front edge of the top 42, and an elongated lip 46 depends downwardly from the rear edge of that top. The numeral 48 denotes an elongated bottom for the panel 40; and that bottom has a length and width corresponding to the length and width of the top 42. Further, the bottom 48 projects forwardly and rearwardly of the web of the panel 40 to the same extent to which the top 42 projects forwardly and rearwardly of that web. An elongated lip 50 extends upwardly from the front edge of the bottom 48, and an elongated lip 52 extends upwardly from the rear edge of that bottom. If desired, the top 42 and the bottom 48 can be provided with shallow ribs, fluting or other ornamentation. Any such ribs, fluting or ornamentation should be shallow enough to permit the bottom 48 of an upper panel and the top 42 of an adjacent lower panel to abut with sufficient intimacy to present a seemingly-unbroken and uninterrupted appearance to a viewer of the signboard.

As shown particularly by FIGS. 2 and 3, the width of each of the top 42 and of the bottom 48 is close to, but slightly smaller than, the width of each elongated recess 22. That difference in width facilitates easy introduction of the ends of panel 40 into the elongated recesses 22 in the supports 10 and 25, and also facilitates easy and rapid shifting of that panel along the lengths of those elongated recesses. The forward portion of the top 42, the forward portion of the bottom 48, the flange 14 on the support 10 and the flange 14 on the support 25 coact to provide a shadow-box effect for the signboard. Similarly, the rear portion of the top 42, the rear portion of the bottom 48, the elongated surface 18 on the support 10, and the elongated surface 18 on the support 25 coact to provide a shadow-box effect for the rear of the signboard.

The numeral 54 generally denotes one of a large number of indicia which can be removably secured to the panel 40. That indicia can, and preferably will, be very similar to the identically-numbered letter which is shown in my U.S. Pat. No. 3,289,340 that was granted on Dec. 6, 1966 for DISPLAY SIGNS.

The numerals 58 and 60 denote elongated shallow abutments which extend forwardly from the front surface of the web of the panel 40. The numerals 62 and 64 denote similar elongated shallow abutments which project rearwardly from the rear face of that web. As shown particularly by FIG. 3, each of those elongated abutments coacts with the web of the panel 40 to subtend an acute angle. Further, the free ends of the elongated abutments 58 and 60 are closer together than are the apices of the angles which are defined by those elongated abutments and the web of panel 40. Similarly, the free edges of the elongated abutments 62 and 64 are closer together than are the apices of the angles which are defined by those elongated abutments and the web of panel 40.

Figure 13:
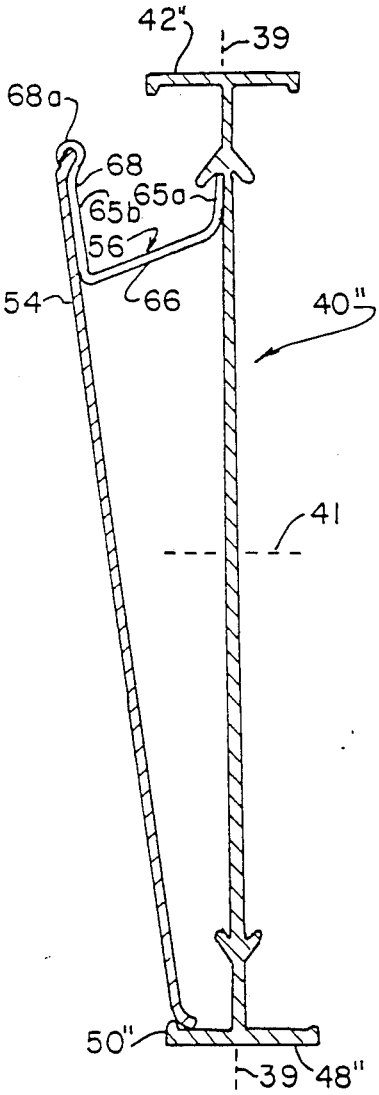
FIG. 13 is a sectional view, on the scale of FIG. 3, of a panel holding indicia in a second mode of indicia mounting.
Figure 11:
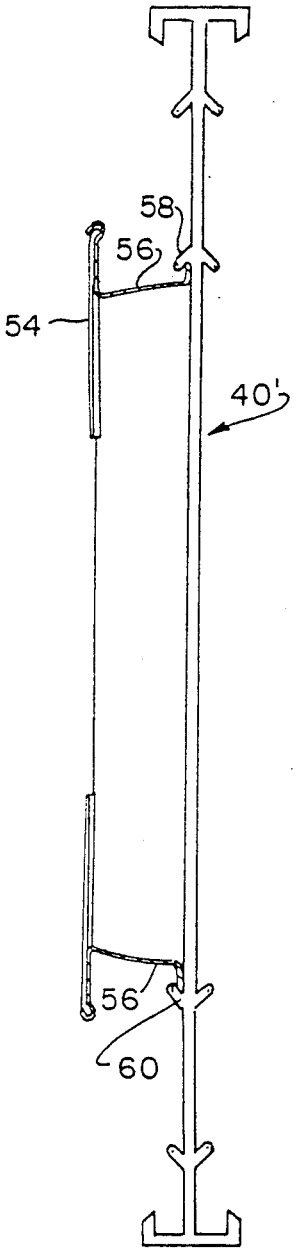
FIG. 11 is a sectional view of a panel holding indicia.
Figure 12:
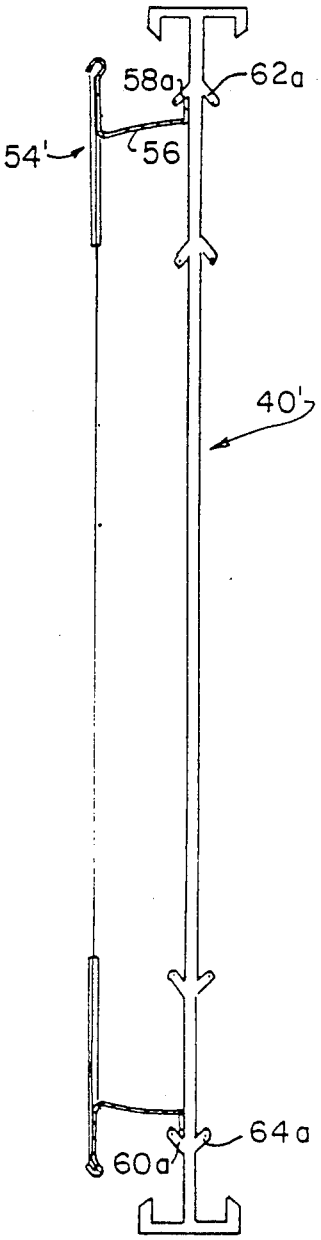
FIG. 12 is a sectional view of the panel of FIG. 11 holding a second size of indicia.
Figure 14:
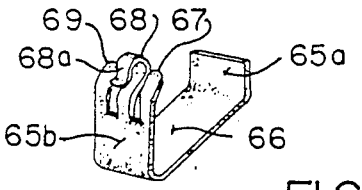
FIG. 14 is a perspective view of clip means for holding indicia on the panels.

The numeral 56 denotes a resilient, indicia-supporting clip which can, and preferably will, be identical to the identically numbered indicia-supporting clip in my above-mentioned patent. The clip 56 has a pair of legs 65*a* and 65*b* which are joined by a connecting section 66. The leg 65*b* has three fingers 67, 68 and 69 which are formed to conform to the shape of the outer edge of the indicia 54. The middle finger 68 is bent over as at 68*a* to coact with the top of the indicia 54. As shown in FIGS. 11–13, the leg 65*a* of clip 56 coacts with the angle subtended by the web of panel 40 and the abutments 58 and 60 to hold the indicia 54 on the panel. The indicia 54 are thus removably mounted to panel 40 by the coaction of the indicia, the clip and the panel.

A panel 40′, shown in FIGS. 11 and 12, includes a set of abutments 58*a*, 60*a*, 62*a* and 64*a*, in addition to abutments 58,60,62, and 64. The abutments 58*a*, 60*a*,62*a* and 64*a* are similar to, and spaced outwardly from, the abutments 58, 60, 62, and 64. The panel 40′ with inner and outer sets of abutments allows for one panel 40′ to hold up to two sizes of indicia 54 and 54′. It will be noted that the panel 40′ could be made with as many sets of abutments a desired to accommodate many more sizes of indicia.

In FIGS. 11 and 12, the indicia 54 and 54′ are secured to panel 40′ with clips 56 at the top and the bottom of the indicia. FIG. 13 shows a panel 40″ wherein the indicia 54 is held by clips only at the top thereof. The bottom of indicia 54 coacts with a lip 50″ of the panel 40″. Panel 40″ has the abutments of the panel 40. However, the top 48″ and bottom 58″ of panel 40″ is larger in length then the top or bottom of the panel 40. The elongate top and bottom 42″ and 48″ prevents the indicia 54 from subtending too great of an angle with lip 50″ when it is held in place. Panel 40″ has a set of abutments as in panel 40. It may thus hold indicia 54 in the same manner as shown in FIG. 11. Panel 40″ may also be formed with a plurality of abutments, as in panel 40″, in order for panel 40″ to be able to hold multiple sized of indicia.

Panels 40, 40′ and 40″ are symmetrical along their longitudinal axis 39, shown in FIG. 13. This allows for indicia 54 or 54′ to be placed on either side of the panels. The panels are also symmetrical about a horizontal axis 41, so that there is no definite top or bottom and it will not matter in what manner the panel is held by supports 10 and 25.

To assemble the panel 40 with the support 10, it is only necessary to insert the left-hand end of that panel into the elongated recess 22; and that is a simple operation, because the widths of the top 42 and of the bottom 48 are smaller than the width of that elongated recess. Thereafter, the bolt 36 will have the polygonal shoulder thereof set in engagement with the confronting edges of the elongated surface 18 and of the elongated surface defined by the right-hand portion of flange 16; and, at such time, the head of that bolt will abut an inner plane defined by those elongated surfaces. The bottom 48 of the panel 40 will be moved close to the shank of that bolt; and the lip 50 on that bottom will abut an outer plane defined by those elongated surfaces. The opening 30 in the planar section 28 of the clip 26 will be telescoped over the shank of that bolt while the lip 34 of that clip engages the lip 50 on the bottom 48. Where the bolt 36 and the panel 40 are disposed close to the top of the channel-like connecting section 20, the installer can insert one end of his finger or one end of a screw driver into the elongated recess 24 to hold the polygonal shoulder of that bolt between the confronting edges of the two elongated surfaces until the cap nut 38 is almost finger-tight on the shank of that bolt.

At this time, a similar clamp, bolt and cap nut can be used to loosely secure the right-hand end of the panel 40 to the support 25. Thereupon, the two clamps 26 will prevent accidental separation of the panel 40 from the supports 10 and 25, but they will permit that panel to be moved downwardly relative to those supports. After the top 42 has been moved a short distance downwardly below the upper ends of those supports, the polygonal shoulders of further bolts 36 can be disposed between the edges of the elongated surfaces 18 and of the elongated surfaces defined by the flanges 16 on the supports 10 and 25. Two additional clips 26 can have the openings 30 therein telescoped over the shanks of those bolts while the lips 34 on those clips are set in engagement with the lip 44 on the front of the top 40 of that panel. Thereafter, while the end of the operator's finger or the end of a screw driver or the like successively holds the head of each bolt 36 in position, a cap nut 38 can be threaded onto the shank of each bolt to hold those clips in assembled relation with the supports 10 and 25. While those cap nuts are in almost finger-tight relation with those bolts, the panel 40 can be shifted up or down within the elongated recess 22 in the support 10 and within the elongated recess 22 in the support 25. It will be understood that the bolts 36 can be set in an infinite number of positions along the lengths of the elongated recesses 24 in the supports 10 and 25. As a result, the positioning of the panel 40 is not restricted to a finite number of specific positions which are dictated by holes that are drilled in those supports. Furthermore, the positioning of that panel will not be restricted by the spacings required between adjacent holes that are drilled in the supports 10 and 25.

Once the panel 40 has been set in a desired position relative to the supports 10 and 25, a wrench, a pair of pliers or some other suitable tool can be used to tighten the cap nuts 38 to prevent accidental shifting of that panel relative to those supports. Thereafter, further panels 40 can be assembled with the supports 10 and 25 in the same manner in which the first panel 40 was assembled with those supports.

As shown particularly by FIG. 1, each panel 40 can be spaced vertically from each adjacent panel. However, if desired, the bottom 48 of any panel 40 can be made to abut the top 42 of the next-lower panel. Where that is done, two or more, and even all, of the adjacent panels of a signboard can abut each other. In such event, clips 26 may be provided for only the uppermost and the lowermost panels; and the remaining panels will be held in position by those uppermost and lowermost panels, and by the side walls 12 and flanges 14 and 16 of supports 10 and 25. If the tops 42 and bottoms 48 of the various panels are provided with shallow ribs or fluting, those tops and bottoms will be particularly resistant to forward or rearward shifting relative to each other. In such event, just four clips 26, and the bolts 36 and cap nuts 38 therefor, will be needed to secure those panels to the supports 10 and 25.

Figure 5:
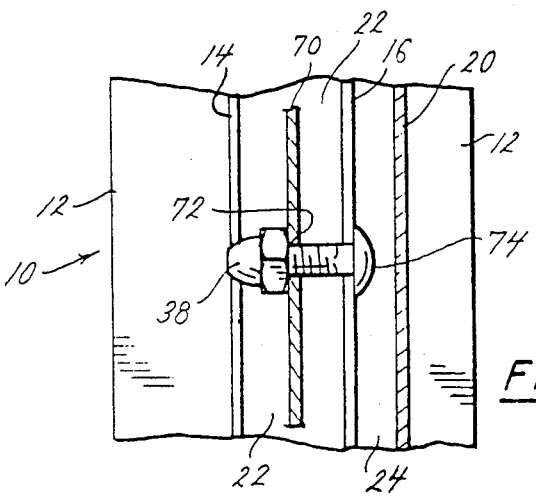
FIG. 5 is a vertical section, on the scale of FIG. 2, through part of the support of FIG. 2 and of a panel which has a bolt-receiving opening therein.

If desired, one or more of the panels for a signboard can be provided with holes to accommodate the shanks of fasteners. Specifically, as shown by FIG. 5, the web of a panel 70 has one end thereof disposed within the elongated recess 22 defined by the flanges 14 and 16 of the support 10. An opening 72 is formed in that web; and that opening will be in register with the gap defined by the elongated surface 18 and by the elongated surface defined by the right-hand portion of flange 16 on support 10. That opening preferably is midway between the top 42 and the bottom 48 of the panel 70. A bolt 74, which has a shank that is longer than the shank of the bolt 36, has a polygonal shoulder on that shank disposed within the gap defined by the elongated surfaces on the support 10. The forward end of that shank extends through the opening 72 to receive a cap nut 38. Tightening of that cap nut will cause the lips 46 and 52, respectively, at the rear edges of the top 42 and bottom 48 of panel 70 to tightly engage the forward faces of flange 16 and of the elongated surface 18 of support 10.

It should be noted that even though the shank of bolt 74 passes through a drilled opening 72 in the panel 70, that panel can be set in any one of an infinite number of desired positions along the lengths of the supports 10 and 25; and hence is not limited to a number of finite positions dictated by the positions of drilled openings in those supports, or dictated by the spacings between openings drilled in those supports. This means that whether the panels of the present invention ar secured to the supports therefor by clips 26 or by bolts 74, those panels can be set in an infinite number of positions along the lengths of those supports.

The channel, not shown, for the bottom of the signboard will usually be secured to the supports 10 and 25 before any panels are assembled with those supports. After all the panels have been assembled with those supports, the channel, not shown, for the top of that signboard will be secured to those supports.

Once the various supports have been secured in position relative to the supports 10 and 25, suitable indicia 54 can have the clips 56 thereof set in the acute angles subtended by the webs of the panels and the various shallow abutments 58 and 60 or 62 and 64. In fact, one set of indicia can be secured to the front faces of the various panels while another set of indicia is secured to the rear faces of those panels.

As shown particularly by FIG. 3, the clips 56 displace the indicia 54 forwardly of the elongated recess 22 but leave that indicia disposed a short distance rearwardly of the front edge of the side wall 12 of the support 10. As a result, that side wall and the corresponding side wall on the support 25 will protect those indicia from being struck by persons or objects which move parallel to the webs of the panels of the signboard. Also, as shown by FIG. 3, the indicia 54 are disposed forwardly of the shadow-box effect which is provided by the flange 14 on support 10 and by the flange 14 on support 25, by the lips 44 on the tops 42, and by the lips 50 on the bottoms 48 of the various panels 40. A similar shadow-box effect is provided by the elongated surfaces 18 on supports 10 and 25, by the lips 46 on the tops 42 and by the lips 52 on the bottoms 48 of the various panels 40. As a result, whether viewed from the front or the back, the signboard will display indicia that ar disposed in front of shadow-box effects.

It should also be noted that each panel is made so it can fully support all of the indicia that are to be associated with it; and hence no indicia is expected, or required, to find support from adjacent panels. As a result, a panel can be shifted up and down relative to the other panels while maintaining its indicia display undisturbed. Moreover, regardless of the position into which any panel is moved, it will automatically display all indicia thereon in front of a shadow-box effect.

The top 42 of each panel will be disposed above the top of each and every indicia supported by that panel. Similarly, the bottom 48 of each panel will be disposed below the bottom of each and every indicia supported by that panel. As a result, each panel will not only support all of the indicia that are associated with it but will automatically protect the upper and lower edges of such indicia.

In assembling a panel 40 with the support 10 or with the support 25, the assembler will usually move the adjacent end of that panel far enough into the elongated recess 22 to engage the side wall 12. However, if any panel 40 is inadvertently cut so its length is slightly shorter than the length of each other panel, the flanges 14 on the supports 10 and 25 will fully conceal both ends of that panel; and the bolts 36 and cap nuts 38 will solidly hold that panel in position relative to those supports.

Referring particularly to FIGS. 6–10, the numeral 80 denotes an elongated extension for the support 25 of the signboard which is shown by FIGS. 1–4. That extension has a width which is slightly larger than the width of the side wall 12 of that support. Elongated L-shaped flanges 82 and 84 are provided at the elongated edges of the extension 80; and those flanges define elongated recesses 86 and 88 at each of those elongated edges. Each of those recesses is large enough to accommodate one edge of the side wall 12 of the support 25; and hence the extension 80 can be telescoped over that side wall, as shown particularly by FIG. 10. The numeral 90 denotes a threaded hole adjacent the lower end of the extension 80; and the numeral 92 denotes an opening adjacent the upper end of that extension. It will be noted that the flanges 82 and 84 are made so the confronting faces thereof are spaced considerable distances away from the flanges 14 and 16 of the support 25, as shown particularly by FIG. 10. As a result, the extension 80 can be freely telescoped axially relative to the support 25 without interfering with that support, with any panels held by that support, or with any indicia held by those panels.

The numeral 96 denotes a T-bracket which has feet that are disposable against the ceiling 105 of a room, as indicated by FIGS. 6 and 7. An elongated vertically-directed slot 98 is formed in the stem of the bracket 96, a slot 100 is formed in one foot of that bracket, and a hole 102 is formed in the other foot of that bracket, all as shown particularly by FIGS. 7 and 8. Fasteners 104, which are shown as screws, but which could be bolts, nails, rivets or the like, are used to secure the T-bracket 96 to the ceiling 105. That T-bracket will be located so the stem thereof will be disposed adjacent the inner face of the extension 80, as indicated particularly by FIGS. 6–8. The shank of a screw 106 extends through the slot 98 in the stem of that T-bracket and through the opening 92 in the extension 80; and a wing nut 108 is threaded onto that shank. The numeral 94 denotes a thumb screw which has the shank thereof disposed within the threaded hole 92 and which has the end of that shank abutting the side wall 12 of the support 25, as shown particularly by FIG. 10.

The numeral 110 denotes a T-bracket which has the feet thereof engagable with a floor 111, as shown particularly by FIGS. 6 and 9. Fasteners 112, which are shown as screws, but which could be bolts, nails, rivets or the like, extend through an opening and a slot, not shown, in the feet of the T-bracket 110 to fixedly secure that T-bracket to the floor 111. A nut and bolt combination 114 extends through a slot 109 in the stem of the T-bracket 110 and through an opening in the support 25 to secure that support to that bracket. In those instances where the signboard of FIGS. 6–10 is to be mounted inside of a building, the feet of bracket 110 may be merely rested upon, and not secured to, the floor.

The numeral 118 denotes an extension which is a mirror image of the extension 80. The lower end of the extension 118 telescopes over the upper end of the support 10 for the signboard of FIGS. 1–5. The upper end of the extension 118 telescopes over the stem of a T-bracket 120 which has the feet thereof secured to the ceiling 105 by fasteners like the fasteners 104. The lower end of the support 10 is secured to a T-bracket 122 by a nut and bolt combination 125; and that T-bracket can be secured to the floor 111 by fasteners like the fasteners 112. A thumb screw 119 is disposed within a threaded opening in the lower end of the extension 118; and the inner end of the shank of that thumb screw can abut the side wall 12 of the support 10. A screw 121 and a wing nut 123 releasably secure the upper end of the extension 118 to the T-bracket 120.

The T-bracket 122 will preferably be identical to the T-bracket 110. As indicated by FIGS. 6 and 9, the stems of those T-brackets will abut, and will be secured to, the outer faces of the side walls 12 of the supports 10 and 25. The T-bracket 120 will differ from the T-bracket 96 in having a stem which has the width and thickness of the side wall 12 of the support 10. As a result, the upper end of extension 118 will telescope over the stem of T-bracket 120, whereas the upper ends of the L-shaped flanges 82 and 84 on extension 80 will abut the stem of T-bracket 96, as shown by FIG. 8.

The extensions 80 and 118 will be telescoped over the supports 25 and 10, respectively, by the supplier of those supports. Those extensions are formed so the flanges 82 and 84 thereof overlie only very small portions of the inner surfaces of the side walls 12 of those supports. As a result, those extensions do not interfere with the panels 128 and 134 or with the indicia mounted on those panels The thumb screws 94 and 119 will be used to hold those extensions substantially coextensive with the supports 25 and 10 during the assembling of the panels 128 and 134 with those supports. It will be noted that the panel 128 is secured to those supports by nuts 130 and 132 which are threaded onto bolts like the bolt 74 in FIG. 5. Those bolts will have the polygonal shoulders on the shanks thereof disposed within the elongated slots defined by flanges 16 and surfaces 18 of the supports 10 and 25. Similarly, the panel 134 is secured to those supports by nuts 136 and 138 which are threaded onto bolts like the bolt 74 in FIG. 5. Those bolts also have the polygonal shoulders on the shanks thereof disposed within the elongated slots defined by flanges 16 and surfaces 18 of the supports 10 and 25. By loosening and then re-tightening the nuts 130 and 132, the panel 128 can be shifted up or down along the lengths of the supports 10 and 25. Similarly, by loosening and then re-tightening the nuts 136 and 138, the panel 134 can be shifted up or down along the lengths of those supports. Those nuts will perform the panel-securing functions of the L-shaped clips 26 of FIGS. 1-5.

The extensions 80 and 118 will continue to be coextensive with the supports 25 and 10 until the signboard is to be erected. At that time, the thumb screws 94 and 119 will be loosened, and the extensions 80 and 118 will be shifted axially of the supports 25 and 10 until the combined length of each extension and of its support is just slightly less than the distance from the floor 111 to the ceiling 105. Thereupon, the thumb screws 94 and 119 will be tightened to hold the extensions in their axially-shifted positions relative to their supports. The T-bracket 96 will be secured to the inner face of the free end of the extension 80 by screw 106 and wing nut 108, as shown by FIGS. 6-8. The T-bracket 120 will have the stem thereof telescoped within the elongated recesses which are defined by the elongated L-shaped flanges at the elongated edges of the extension 118; and then the screw 121 and wing nut 123 will be used to secure that T-bracket to that extension.

The T-brackets 110 and 122 will then be secured to the lower ends of the supports 25 and 10, respectively. If those T-brackets are to be secured to the floor 111, fasteners will be passed though the slots 100 and the holes 102 in those T-brackets and seated in that floor. Suitable forces will be applied to the supports 10 and 25, either by one or more persons or by one or more braces, to raise those supports and the rest of the signboard to a substantially-vertical position. Thereafter, while those supports are held in that substantially-vertical position, the thumb screw 119 will be loosened and the extension 118, together with the previously-mounted T-bracket 120 at the free end thereof, will be shifted upwardly until the feet of that T-bracket engage the ceiling 105. That T-bracket will then be secured to that ceiling; and it will act to hold the upper end of extension 118 in position relative to that ceiling. The thumb screw 94 will then be loosened and the extension 80, together with the previously-mounted T-bracket 96 at the free end thereof, will be shifted upwardly until the feet of that T-bracket engage the ceiling 105. That T-bracket will then be secured to that ceiling; and it will coact with the T-bracket 120 to hold the signboard in a substantially-vertical position.

The T-brackets 96 and 120 at the upper ends of the extensions 80 and 118, respectively, will hold the signboard substantially vertical throughout the time that signboard is to be left undisturbed. If one face of that signboard is close to a store window, and if any of the indicia on that face is to be changed, it is only necessary to loosen thumb screw 119, to remove the wing nut 123 and the screw 121, to shift the extension 118 axially toward the floor 111, and to remove the wing nut 108 and the screw 106 to free the signboard from the ceiling 105. At such time, the thumbscrew 94 can be loosened to permit the extension 80 to be shifted a short distance axially toward the floor 111 to enable the upper ends of both extensions to move freely away from the T-brackets 96 and 120. The thumb screws 94 and 119 will be tightened to hold the extensions 80 and 118 against further axial shifting relative to the supports 25 and 10; and then those supports and the signboard will be rotated about the bolt and nut combinations 114 and 125 to move the one face of that signboard away from the window. If the T-brackets 110 and 122 are not secured to the floor 111, those T-brackets will rotate with the supports 25 and 10 as though they were integral parts of those supports. However, if the T-brackets 110 and 122 are secured to the floor, the supports 10 and 25 will rotate about the nut and bolt combinations 114 and 125, and the slots 109 in the stems of those T-brackets will enable those nut and bolt combinations to rise upwardly as the midpoints of the bottoms of the supports 10 and 25 rise upwardly relative to the feet of those T-brackets.

The downward rotation of the signboard can be halted while that signboard is far enough from the floor 111 and from the window to enable the indicia at both sides of that signboard to be changed. Alternatively, the indicia at the side of the signboard which faces away from the window could be changed before or after the signboard was rotated downwardly; and, in such event, the signboard could be rotated into a generally-horizontal position to facilitate the changing of the indicia at the one face thereof. The positions, and the numbers, of the panels of the signboard can easily be changed whenever that signboard is in its lowered position; because the L-shaped flanges at the elongated sides of the extensions 80 and 118 are always spaced considerable distances away from those panels and from the flanges 14 and 16 which define the recesses 22 for the ends of those panels.

The pivoting action of the nut and bolt combinations 114 and 125, the freedom of those nut and bolt combinations to slide within the slots 109 in the stems of the T-brackets 110 and 122, the securability of those T-brackets to the floor 111, and the ready separability of the extensions 80 and 118 from the T-brackets 96 and 120 are very desirable; because they enable the signboard to be rotated downwardly in a controlled manner by the application of forces to the upper ends of the extensions 80 and 118—even where that sign is mounted immediately adjacent an exterior window. In the absence of those features, it would be necessary to apply controlling forces to the lower ends of the supports 10 and 25 as well as to the upper ends of the extensions 118 and 80, to move the signboard into position to have the indicia thereon changed.

Once any desired replacement of indicia, and any desired positioning of or changes in the number of panels, have been effected, the supports 25 and 10 and the extensions 80 and 118 can be rotated upwardly toward the generally-vertical position shown by FIG. 6. The thumb screw 94 will then be loosened to enable the upper end of the extension 80 to be set in position in register with the stem of the T-bracket 96; and, at such time, the screw 106 and the wing nut 108 can be replaced. Thereafter, the thumb screw 119 can be loosened, and the extension 118 can be moved upwardly so the upper end thereof telescopes over the stem of the T-bracket 120. At such time, the screw 121 and the wing nut 123 can be used to again secure that extension to that T-bracket, and hence to the ceiling 105. The nut and bolt combinations 114 and 125 will move downwardly in the slots 109 in the stems of the T-brackets 110 and 122 as the supports 25 and 10 are rotated upwardly to that generally-vertical position; and, thereafter, those nut and bolt combinations will coact with the screws 106 and 121 and with the wing nuts 108 and 123 to hold the signboard in that position.

The extension 80 is just slightly wider than the side wall 12 of the support 25; and, similarly, the extension 118 is just slighter wider than the side wall 12 of the support 10. In addition, elongated ornamental ribs or fluting 140 on the outer face of the extension 80 are in register with similar elongated ornamental ribs or fluting 142 on the outer face of the side wall 12 of the support 25; and corresponding elongated ornamental ribs or fluting on the outer face of the extension 118 are in register with similar elongated ornamental ribs or fluting on the outer face of the side wall 12 of the support 10. As a result, those extensions will appear to be integral parts of the supports 10 and 25, irrespective of the extents to which those extensions are shifted out of register with those supports.

Both of the T-brackets 96 and 120 could be made with stems that were wider than the width of extension 80 or extension 118. In such event, those stems would be mounted in abutting engagement with the free ends of those extensions; and the removal of screws 106 and 121 would immediately free those free ends from the ceiling 105. Alternatively, both of the T-brackets 96 and 120 could be made with stems that were narrow enough and thin enough to fit within the elongated recesses which are defined by the upper ends of the elongated L-shaped flanges at the elongated edges of the extensions 80 and 118. In such event, those stems would be telescoped over the free ends of those extensions; and the removal of screws 106 and 121 plus the axial shifting of those extensions toward the floor 111 would immediately free those free ends from the ceiling 105.

Whereas the drawing and accompanying description have shown and described two preferred embodiments of the present invention, it should be apparent to those skilled in the art that various changes may be made in the form of the invention without affecting the scope thereof.

Having thus described the invention, what is claimed and desired to be secured by Letters Patent is:

1. In a display system which provides a background with indicia removably mounted in front thereof, the improvement which comprises:

a panel which forms part of said background, the panel having means for coacting with indicia mounting means and mounting means for coacting with at least two sizes of indicia;

a support that has an elongated channel-like space which can accommodate one end of said panel;

a fastener;

elongated spaced surfaces adjacent said channel-like space which can accommodate part of said fastener and which can permit said fastener to be disposed in an infinite number of positions along the length of said elongated spaced surfaces;

a second generally channel-like means which is integral with and fixes the positions of, said elongated spaced surfaces; wherein said elongated spaced surfaces define an elongated slot which is displaced about ninety degrees from said first elongated channel-like space that accommodates said end of said panel; and a clamp which has one portion thereof disposable adjacent said elongated spaced surfaces and which has another portion thereof engagable with a part of said panel to hold said part of said panel against movement relative to said elongated spaced surfaces; said fastener having a portion thereof held by said elongated spaced surfaces and having another portion thereof which engages and holds said clamp to thereby hold said panel against movement relative to said support.

2. The display system of claim 1 wherein said clamp is generally L-shaped in side elevation and has a lip which engages said part of said panel.

3. The display system of claim 1 wherein said elongated spaced surfaces define an inner plane and an outer plane, wherein said fastener has a head that abuts said inner plane, and wherein said panel has a further part that abuts said outer plane.

4. The display system of claim 1 wherein said clamp is dimensioned to hold said part of said panel against movement relative to said elongated spaced surfaces irrespective of the extent to which said one of said panels extends into said first elongated channel-like space.

5. The display system of claim 1, wherein said indicia mounting means includes a clip which coacts with said indicia; said coacting means includes a shallow elongate rib which projects forwardly from the front of said panel and coacts with said panel to subtend on acute angle; and said mounting means includes a lip at the top or bottom of said panel proximate from said rib.

6. In a display system which provides a background with indicia removably mounted in front thereof, the improvement which comprises:

a plurality of spaced-apart supports;

a panel which spans the space between, and which is supported by, said supports and which forms part of said background;

at least two sizes of indicia which can be removably mounted in front of, and supported by, said panel;

said panel having mounting means thereon which can coact with mounting means on said indicia to removably mount at least two sizes of indicia in front of said panel;

said mounting means on said panel including at least two downwardly facing shallow, elongated ribs which project forwardly from the front of said panel and coact with said front of said panel to subtend an acute angle, and at least two upwardly facing shallow, elongated ribs which project forwardly from said front of said panel and coact with said front of said panel to subtend an acute angle; wherein said shallow, elongated ribs have free edges which are closer to each other than are the apices of said acute angles; and said mounting means on said indicia including clip means which coact with said ribs and with the periphery of said indicia.

7. In a display system as claimed in claim 6 wherein each of said supports has an elongated channel-like space which can accommodate one end of said panel, a fastener, each of said supports having elongated spaced surfaces adjacent said elongate channel-like space which can accommodate part of said fastener and which can permit said fastener to be disposed in an infinite number of positions along the length of said elongated spaced surfaces, a clamp which has one portion thereof disposable adjacent said elongated surfaces and which has another portion thereof engagable with a part of said panel to hold said part of said panel against movement relative to said elongated spaced surfaces, said fastener having a portion thereof held by said elongated spaced surfaces and having another portion thereof which engages and holds said clamp to thereby hold said panel against movement relative to said support, said panel having a top which is spaced far enough above said mounting means on said panel to always be disposed above the level of the top of an indicia that has the mounting means thereon held by said mounting means on said panel, said panel having a bottom which is spaced far enough below said mounting means on said panel to always be disposed below the bottom of said indicia that has said mounting means thereon held by said mounting means on said panel, whereby said mounting means on said panel will always coact with the mounting means on any indicia which is supported by said mounting means on said panel to dispose the top and bottom of said indicia inwardly from the top and bottom, respectively, of said panel in one indicia mounting mode; said bottom having a lip at the front thereof which coacts, with said indicia to removably mount said indicia in a second indicia mounting mode, each of said supports having a portion which projects forwardly beyond a major portion of said panel, and said top and said bottom coacting with portions of said supports to provide a shadow-box effect for said display system.

8. A display system as claimed in claim 6 wherein said top and said bottom of said panel project forwardly beyond a major portion of said panel, wherein each of said supports has a portion which projects forwardly beyond said major portion of said panel, and wherein said top and said bottom coact with said portions of said supports to provide a shadow-box effect for said display system.

9. A display system as claimed in claim 8 wherein said shallow, elongated ribs are disposed within said shadow-box effect for said display system, and wherein said indicia are disposed forwardly of said shadow-box effect for said display system.

10. In a display system which provides a background with indicia removably mounted in front thereof, the improvement which comprises a plurality of spaced-apart supports, a panel which spans the space between, and which is supported by, said supports and which forms part of said background, each of said supports having an elongated channel-like space which can accommodate one end of said panel, a fastener, each of said supports having elongated spaced surfaces adjacent said elongated channel-like space which can accommodate part of said fastener and which can permit said fastener to be disposed in an infinite number of positions along the length of said elongated spaced surfaces, said fastener having a portion thereof held by said elongated spaced surfaces to hold said panel against movement relative to said support, indicia which can be removably mounted in front of, and supported by, said panel, said panel having mounting means thereon which can coact with mounting means on said indicia to removably mount at least two sizes of said indicia in front of said panel, said mounting means on said indicia facilitating removal of said indicia from said panel without disasembling said display system.

11. A display system as claimed in claim 10 wherein said panel has a top which is spaced far enough above said mounting means on said panel to always be disposed above the level of the top of an indicia that has the mounting means thereon held by said mounting means on said panel, wherein said panel has a bottom which is spaced far enough below said mounting means on said panel to always be disposed below the bottom of said indicia that has said mounting means thereon held by said mounting means on said panel, whereby said mounting means on said panel will always coact with the mounting means on any indicia which is supported by said mounting means on said panel to dispose the top and bottom of said indicia inwardly from the top and bottom, respectively, of said panel, wherein each of said supports has a portion which projects forwardly beyond a major portion of said panel, wherein said top and said bottom coact with portions of said supports to provide a shadow-box effect for said display system, and wherein said top and bottom of said panel each have a lip which may coact with said indicia to allow for mounting of said indicia with indicia mounting means, at only the top or bottom of said indicia.

12. A mounting, for a generally-vertical signboard that has means for removably retaining at least two sizes of indicia thereon and means for securing said indicia in two differing mounting modes, the mounting facilitating the tilting of said signboard away from the vertical and which comprises a first bracket and a second bracket which are supportable on a floor; a third bracket and a fourth bracket which are securable to a ceiling; a first support for said signboard that has the lower end thereof securable to said first bracket to be rotatable relative thereto, an extension that is secured, but is slidable axially relative, to said support and that has the upper end thereof releasably securable to said third bracket, a second support for said signboard that has the lower end thereof securable to said second bracket to be rotatable relative thereto, a second extension that is secured, but is slidable axially relative to, said second support and that has the upper end thereof releasably securable to said fourth bracket, said upper ends of the first and second extensions being securable to said third and fourth brackets to coact with the securement of said lower ends of the first and second supports to said first and second brackets to hold said signboard in said generally-vertical position, said upper ends of said first said and said second extensions being separable from said third and fourth brackets and said first and second extensions being slidable axially toward said lower ends of said first and second supports to enable said first and second supports and said signboard to be rotated downwardly to a position wherein said indicia can be changed.

13. A mounting as claimed in claim 12 wherein said first and third brackets are in general vertical alignment, and wherein said second and fourth brackets are in general vertical alignment.

14. A mounting as claimed in claim 12 wherein the width of said first and second extensions and the width of said first and second supports are very similar, wherein said first and second extensions have ornamentation thereon which is in register with and appears to be a continuation of ornamentation on said first and second supports, whereby said first and second supports appear to be integral with said first and second extensions, respectively.

15. A mounting as claimed in claim 12 wherein said first and second brackets each include an elongate vertical slot allowing said first and second supports to be rotatable and vertically slidable relative to said first and second brackets, whereby said first and second brackets can hold said lower ends of said first and second supports against lateral movement but can permit said lower ends to rotate and to move vertically.

16. A mounting as claimed in claim 12 wherein said first said and said second extensions have elongated flanges at the elongated sides thereof which accommodate elongated sides of said first and second supports but which are spaced wholly away from all indicia on said signboard, whereby said first and second extensions can be shifted axially relative to said first and second supports while indicia is mounted on said signboard.

17. A mounting as claimed in claim 12 wherein said first and second supports have panel-supporting flanges that project outwardly from the confronting faces of said first and said second supports, wherein said first and second extensions abut the outer faces of said first and said second supports and have elongated flanges at the elongated sides thereof which accommodate elongated sides of said first and said second supports but which are spaced wholly away from said panel-supporting flanges on said confronting faces of said first and said second supports whereby said first and second extensions can be shifted axially relative to said first and said second supports while panels are held by said panel-supporting flanges.

18. A mounting as claimed in claim 12 wherein said third and fourth brackets telescope into the upper ends of said first said and said second extensions so that said extensions surround said third and fourth brackets.

19. A signboard, which is readily mounted within an area that has a floor and a ceiling, and which comprises a support that is underlain by said floor, indicia-supporting members that are secured to and project outwardly from one side of said support, said support having the opposite face thereof free of obstructions, and an extension which abuts and is axially slidable relative to said opposite face of said support, said support and said extension having interacting surfaces at the side edges thereof which hold said support and said extension in assembled relation but which are spaced outwardly from said indicia-supporting members, whereby said extension can be slid axially relative to said support without disturbing said indicia-supporting members, wherein said indicia-supporting member has means for coacting with mounting means on said indicia and means for coacting directly with said indicia for removably mounting at least two sizes of said indicia on said indicia-supporting member.

20. A signboard as claimed in claim 19 wherein said indicia-supporting members are horizontally-directed panels, and wherein an elongated recess in said support receives one end of each of said panels.

21. The display system of claim 20 wherein said support includes a generally channel-like means which is integral with, and fixes the positions of, said elongated spaced surfaces, and wherein said elongated spaced surfaces define an elongated slot which is displaced about ninety degrees from said elongated channel-like space that accommodates said end of said panel.

22. In a display system which provides a background with indicia removably mounted in front thereof, the improvement which comprises:

a panel which forms part of said background, the panel having means for coacting with mounting means on said indicia to mount at least two sizes of said indicia on said panel in one more of indicia mounting and mounting means for coacting with said indicia to mount said indicia in a second mode; wherein each said mounting means on said panel mounts said indicia so that said indicia are readily removable from said panel;

a support that has an elongated channel-like space which can accommodate one end of said panel;

a fastener; and, elongated spaced surfaces adjacent said recess which can accommodate part of said fastener and which can permit said fastener to be disposed in an infinite number of positions along the length of said elongated spaced surfaces, said fastener having said part thereof disposable adjacent said elongated spaced surfaces and having another part thereof engagable with a part of said panel to hold said part of said panel against movement relative to said elongated spaced surfaces.

23. In a display system which provides a background with indicia removably mounted in front thereof, the improvement which comprises:

a panel which forms part of said background, the panel having means for coacting with mounting means on said indicia to removeably mount at least two sizes of said indicia on said panel in one mode of indicia mounting and mounting means for coacting with said indicia to removeably mount said indicia in a second mode;

a support that has an elongated channel-like space which can accommodate one end of said panel;

a fastener;

elongated spaced surfaces adjacent said recess which can accommodate part of said fastener and which can permit said fastener to be disposed in an infinite number of positions along the length of said elongated spaced surfaces, said fastener having said part thereof disposable adjacent said elongated spaced surfaces and having another part thereof engagable with a part of said panel to hold said part of said panel against movement relative to said elongated spaced surfaces;

wherein said support includes a generally channel-like means which is integral with, and fixes the positions of, said elongated spaced surfaces; and wherein said elongated spaced surfaces define an elongated slot which is displaced about ninety degrees from said elongated channel-like space that accommodates said end of said panel.

24. A display system including:

a panel including at least two downwardly extending ribs which form an acute angle with said panel and at least two upwardly extending ribs which form an acute angle with said panel, a top having a downwardly extending lip, and a top having an upwardly extending lip;

a plurality of supports which support said panel;

at least two sizes of indicia which are removably mounted on said panel, said indicia including a periphery; and first clip means which coacts with an upper portion of said indicia periphery and with a downwardly extinding rib and second clip means which coacts with a lower portion of said indicia periphery and with an upwardly extending rib to mount said indicia in a first mounting mode, and third clip means which coacts with one of said upper or lower portions of said indicia periphery and one of said downwardly or upwardly extending ribs, respectively, to mount said indicia in a second indicia mounting mode, wherein said indicia coacts with one of the lip of the said bottom of said panel or the lip of said top of said panel.

* * * * *